United States Patent [19]

Allen

[11] 4,061,109

[45] Dec. 6, 1977

[54] COATING AND SMOOTHING APPARATUS

[75] Inventor: Roger Anthony Allen, Gt. Missenden, England

[73] Assignee: Wiggins Teape Limited, London, England

[21] Appl. No.: 665,225

[22] Filed: Mar. 9, 1976

[30] Foreign Application Priority Data

Mar. 10, 1975 United Kingdom ..... 9788/75

[51] Int. Cl.[2] ..... B05C 11/02

[52] U.S. Cl. ..... 118/118; 29/121.1

[58] Field of Search ..... 118/118, 119, 110, 262, 118/DIG. 15, 419; 29/121.1; 427/364

[56] References Cited

U.S. PATENT DOCUMENTS

| | | | |
|---|---|---|---|
| 1,924,994 | 8/1933 | Knapp | 118/118 X |
| 2,288,675 | 7/1942 | Berry | 29/121.1 X |

*Primary Examiner*—Louis K. Rimrodt

*Attorney, Agent, or Firm*—Burns, Doane, Swecker & Mathis

[57] ABSTRACT

A smoothing roll for use with apparatus for coating a web of paper or other sheet material, particularly for smoothing coatings at low wet coatweights of silicone compositions applicable in their natural state without the use of a solvent, has a soft elastomeric covering the smoothing surface of which is pitted and is substantially impermeable to liquid coating compositions.

7 Claims, 4 Drawing Figures

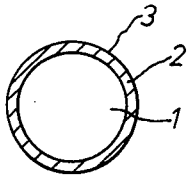
FIG. 1.
FIG. 2.
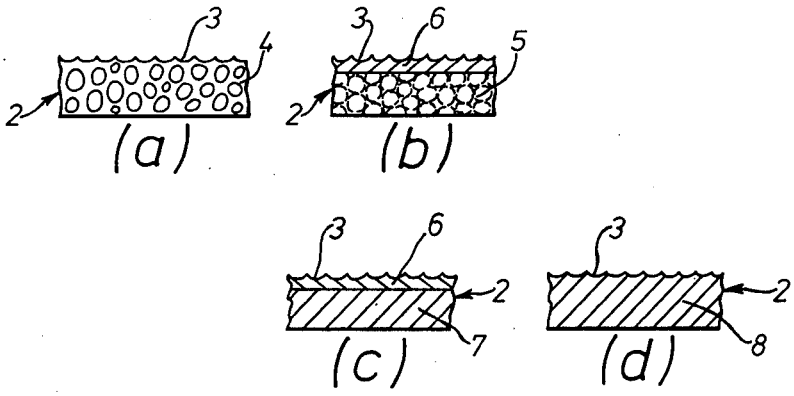
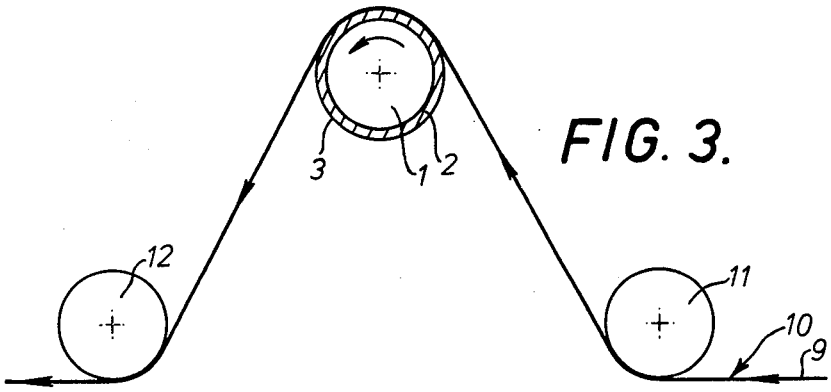
FIG. 3.

COATING AND SMOOTHING APPARATUS

This invention relates to a smoothing roll for smoothing a wet coating applied to a web of paper or other sheet material, and to a coating apparatus including such a roll.

A problem sometimes encountered in coating paper with a liquid coating composition is that a coating applied at a coating station may not have a good coating pattern, e.g. it may not be of even thickness. It has been proposed to overcome this problem by the use of a so-called smoothing roll which contacts the coated surface of the web and acts to enhance the evenness of the coating over the whole web.

Most previously proposed smoothing rolls have smooth steel surfaces, for example chrome plated steel surfaces. Other surfaces have however been proposed. For example, U.S. Pat. No. 3 186 681 discloses the use of "spread shafts" coated with a relatively smooth non-wettable material, for example polytetrafluoroethylene, brass or hard rubber, for smoothing a coating composition containing microcapsules and cellulose fibre floc. Such a coating composition is commonly used for coating paper for use in pressure-sensitive copying systems. Another proposal is to be found in U.S. Pat. No. 1 924 994, which discloses the use of a smoothing roll having a yielding absorptive surface, e.g. of plush or felt, for coating fluid suspensions of mineral pigments. So far as is known, such a roll has not been widely used, if it has been used at all.

Hard surfaced smoothing rolls of the kind discussed above have been widely used. However, they have been found to be not entirely satisfactory for smoothing coatings of very low wet coatweight, for example in the range 0.1 to 1.0 g/m$^2$. Such low coatweights are desirable, for example, for silicone release materials of the so-called solventless type. For economic reasons it is essential to use the minimum possible coatweight. For practical reasons it is important to ensure complete and even coverage of the surface to be coated, as otherwise there will not be an even release over the whole surface of the web. It is therefore desirable to smooth the coating once it has been applied, e.g. by gravure coating. The coating of silicone release materials will be discussed in more detail hereafter.

It has now been found that an improved smoothing effect can be obtained for low wet coatweight coatings, particularly of silicone release material of the so-called solventless type, if, instead of a hard surfaced smoothing roll, a smoothing roll is used having a soft elastomeric covering, the smoothing surface of which is pitted and is substantially impermeable to liquid coating compositions.

According to a first aspect of the invention, there is provided a smoothing roll having a soft elastomeric covering, the smoothing surface of which is pitted and is substantially impermeable to liquid coating compositions.

According to a second aspect of the invention, there is provided apparatus for coating a web of paper or other sheet material, comprising means for applying a liquid coating composition to a surface of the web, and, beyond said means in the direction of web movement, a smoothing roll having a soft elastomeric covering, the smoothing surface of which is pitted and is substantially impermeable to liquid coating compositions, the smoothing roll being drivable in use to permit its surface to move relative to the coated surface of the web, thereby to smooth the coating previously applied by said means.

According to a third aspect of the invention there is provided a method of coating a web of paper or other sheet material, comprising the steps of applying a liquid coating composition to the web, and, while the coating composition is still liquid, smoothing the coating by wiping contact with an elastomeric material moving relative to the web, the smoothing surface of the elastomeric material being pitted and substantially impermeable to the liquid coating composition.

The present smoothing roll differs from that disclosed in U.S. Pat. No. 1 924 994 in that it is elastomeric, rather than merely soft, in that it is completely nonabsorptive, and in that it has a pitted smoothing surface. The known roll has the disadvantage that it absorbs coating composition, and hence it takes a long time before a reproducible coatweight can be applied (if the roll absorbs coating composition, the coatweight on the web is not steady). A further disadvantage is that fibres of plush or felt tend to become detached from the roll and lodged in the coating. Yet a further disadvantage, in the case of a curable coating. such as a silicone release material, the absorbed coating cures while in the smoothing roll. Its original softness therefore changes very rapidly to a lumpy uneven hardness, which prevents the achievement of complete even coverage.

Advantageously, the covering of the present roll is of a cellular elastomeric material of which the cells are closed cells, i.e. they do not communicate with one another. The material may be, for example, foamed neoprene, foamed natural rubber, foamed synthetic rubber or foamed polyurethane, preferably having a density of 0.1 to 0.5 g/cm$^3$. The pitted smoothing surface of the cellular elastomeric material is made up of part cells. The material should preferably not have a skin, although its surface must be substantially impermeable to liquid coating compositions. It is important that the material should not take up the coating composition, as might occur with a material having open cells, i.e. cells which communicate with one another. The disadvantages of take up of coating composition have been referred to in connection with the prior art. An example of a closed-cell elastomeric foamed material which may be used is that sold by Volcrepe Limited as "Volacel" RN foam, which is a foamed neoprene material with a density of 0.35 g/cm$^3$.

Although a cellular material as just described is preferred, other types of covering may be employed. For example, a soft solid natural or synthetic rubber, for example with a hardness of about 30° Shore and a density of up to 0.9 g/cm$^3$ may be used, provided its surface is pitted. Alternatively, a material having a laminar construction may be used, for example a surface layer composed of a solid rubber with a pitted external surface on a resilient under layer of elastomeric material which may be solid or cellular. If such a surface layer is provided, an open cell foam may equally well be used for the base, since the skin prevents substantial uptake of coating composition.

A typical construction for the present smoothing roll might be a 4 inch diameter steel roll covered with a ¼ inch thick layer of the covering, for example "Volacel" RN closed cell neoprene foam.

In use of the present smoothing roll, the roll is driven such that its surface moves relative to the web surface. The ratio of the web speed to roll surface speed is not critical, but there should desirably be a difference between these speeds of at least 5 ft/min, and preferably of the order of 200 ft/min. It is the difference in speed which is important, and therefore the roll can be used when rotating in either sense, i.e. with the web or against the web. Desirably, the direction in which the web moves should change by at least 5°, and preferably of the order of 45°, at the smoothing roll. This will depend to some extent on the coating composition being smoothed however.

The covering may conveniently be applied to the roll by spirally wrapping a strip of the covering around the rod. Preferably the covering material is a self-adhesive strip, to facilitate its application to the roll.

The present smoothing roll is not limited to use with any particular means for applying the liquid coating composition, but it is especially suitable for use when low wet coatweights have to be smoothed, for example in combination with a gravure roll coater, particularly a gravure roll coater as described in British Pat. No. 1,404, 616. Such a coater, which will be more fully described hereinafter, comprises a gravure pick-up roll, a transfer roll which receives the coating material from the pick-up roll, an applicator roll which receives coating material from the transfer roll and applies it to the web to be coated and a backing roll which maintains the web being coated in contact with the applicator roll, the backing, applicator and transfer rolls all being arranged to rotate in the same sense and the applicator roll being drivable independently of the transfer roll and the gravure roll to facilitate the application of an even coating and to enable the coatweight to be controllable independently of the speed of rotation of the transfer roll and the gravure roll.

In order to enable the invention to be more readily understood, reference will now be made to the accompanying drawings, which illustrate diagrammatically and by way of example, some embodiments thereof, and in which:

FIG. 1 is an end view of a smoothing roll;

FIG. 2 illustrates four alternative types of a covering forming part of the smoothing roll shown in FIG. 1;

FIG. 3 is an end view of the amoothing roll in use.

Figure 4:
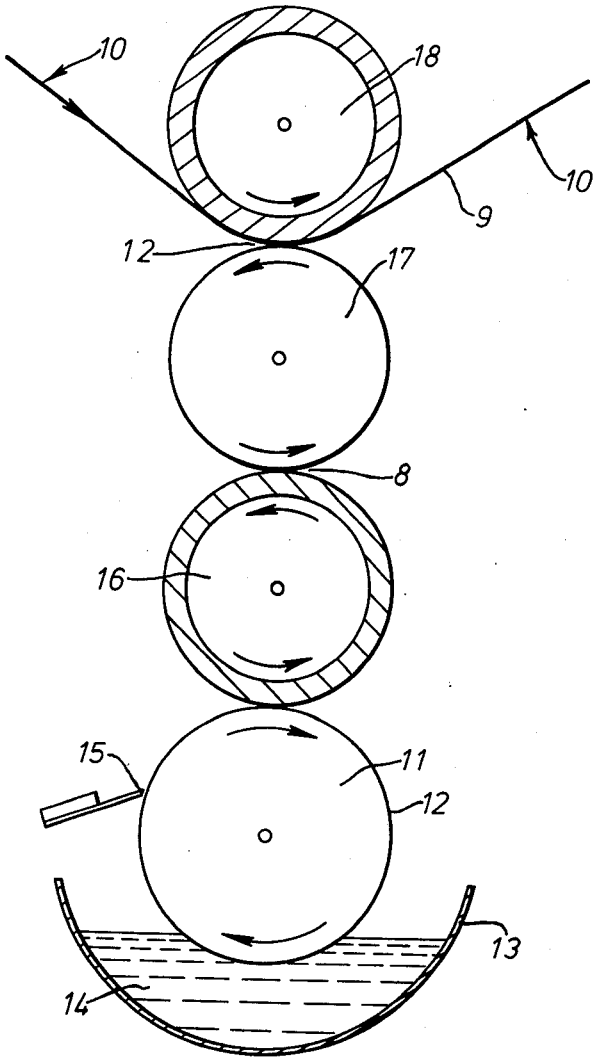
FIG. 4 illustrates a coating apparatus as described in British Pat. No. 1,404,616, which is particularly suitable for use in combination with the smoothing roll shown in FIG. 1.

Referring first to FIG. 1, a smoothing roll comprises a roll 1 having a soft elastomeric covering with a pitted smoothing surface 3 (the pitted surface has not been shown in FIG. 1 for the sake of clarity). The covering 2 may take various forms, four of which are shown in FIGS. 2*a*–2*d*. FIG. 2*a* shows a material which is a closed-cell foamed elastomeric material, e.g. foamed neoprene, foamed natural or synthetic rubber or foamed polyurethane. The surface 3 of the material is formed by half cells of the material rather than by a distinct skin. FIG. 2*b* shows a laminar covering material which comprises an under layer 5 of an open-cell foamed elatomeric material, and a surface layer 6 bonded to the layer 4. The surface layer 6 has a pitted surface 3. FIG. 2*c* shows a laminar covering which is similar to that shown in FIG. 2*b*, but instead of an open cell foam layer 4, a soft rubber layer 7 is employed. FIG. 2*d* illustrates a covering 2 which is of soft rubber alone, e.g. of a hardness of about 30° Shore, the surface of which has been pitted, e.g. by an embossing technique.

The covering 2 may take various forms. For example, it may be a self-adhesive strip which is applied to the roll in spiral fashion. Alternatively, it may be a cylindrical sleeve. Such a sleeve may be produced by wrapping a sheet of material round the roll and then seaming the sheet. Alternatively, a pre-formed sleeve may be used. The covering may alternatively be applied to the roll as a coating, and may then be foamed while it is actually on the roll.

Referring now to FIG. 3, there is shown a smoothing roll being used to smooth a coating on a surface 9 of a web 10. The coating has been applied previously at a coating station (not shown), as will be described hereafter. The web 10 passes round an idler roll 11 and over the smoothing roll 1. The surface 9 contacts the surface 3 of the covering 2 of the roll 1 as it passes round the roll 1. The web then passes round a further idler roll 12. The smoothing roll is driven at a speed about 200 ft/min faster than that of the web, as has previously been mentioned.

Referring now to FIG. 4, there is shown a web 10 being coated on its surface 9 by a gravure coating apparatus. The coating apparatus comprises a gravure roll 11 having a gravure surface 12. The roll 11 dips into a coating composition 14 contained in a bath 13 and excess coating composition picked up by the gravure roll 11 is removed by a doctor blade 15. A rubber coated transfer roll 16 is positioned in surface contact with the gravure roll 11 and is driven to rotate in an opposite sense to the gravure roll 11. The gravure roll 11 is driven by contact with the transfer roll 16. The transfer roll 16 receives the coating from the gravure roll 11 and in turn transfers it to an applicator roll 17 which is positioned above the transfer roll 16 and is independently driven to rotate in the same sense as the transfer roll 16. A rubber covered backing roll 18 is positioned above the applicator roll 17 and maintains the web 10 in contact with the roll 17. The backing roll 18 is driven in the same sense as the applicator and transfer rolls 17 and 16. As the web 10 passes between the backing roll and the applicator roll, the lower surface 9 of the web (as viewed in FIG. 1) receives the coating.

The present smoothing roll is particularly suited to the smoothing of silicone coatings at low wet coatweights. Conventionally, silicone coatings are applied to sheet material in solvent solution, and thus to get a low dry coatweight, a considerably greater wet coatweight has to be applied. The solvents used present a problem in that they tend to be serious pollutants, and so they have to be recovered, which leads to extra expense in energy and capital equipment. Recently however, there have been made available silicone compositions which can be applied in their natural liquid state without the use of a solvent. For economic reasons, the coatweight of the silicone applied must be low and since no solvent is present, the wet coatweight is also low. Coating apparatus for applying such low wet coatweights has been found not to five as good a coating pattern as is desirable, but it has been found that the present smoothing roll can produce a marked improvement in this regard. This is apparent from the measurement of the force required to release a silicone coated paper from an adhesive-coated backing (silicone coatings are frequently employed for use as so-called release papers for self-adhesive products such as labels). If the coating is uneven, it is found that a high force is required to remove an adhesive-coated backing but that if it is even, the force required is much reduced. Measurements of this force therefore provide a good indication as to the evenness or otherwise of the coating.

In order to illustrate the advance in evenness obtained using the present smoothing roll, there are set out in the Table below some comparative results for coatings which have not been smoothed at all, and for coatings which have been smoothed with various types of smoothing roll. In each case, the release force was measured by laminating a silicone coated paper to an adhesive-coated paper and measuring the force required to peel the release paper away from the adhesive-coated paper. In the Table, the force referred to is the force required to peel a 2 inch wide strip of silicone-coated release paper away from an adhesive-coated paper at a rate of 12 inches/min.

In the Table, the asterisks each indicate an example of a paper the silicone coating on which has been smoothed by the present smoothing roll.

THE TABLE

| Smoothing Method | Dry Coatweight of Silicone $g/m^2$ | Force required (gm. wt) |
|---|---|---|
| None (as coated) | 1.0 | 270 |
| Steel smoothing roll | 1.0 | 100 |
| *Soft (30° Shore) solid rubber | 1.0 | 32 |
| *Volacel RN foam | 1.0 | 20 |

I claim:

1. Apparatus for coating a web of paper or other sheet material, comprising means for applying a liquid coating composition to a surface of the web, and, beyond said means in the direction of web movement, a smoothing roll having a soft elastomeric covering with a smoothing surface which is pitted, said pitted smoothing surface being substantially impermeable to liquid coating compositions, the smoothing roll being drivable in use to permit its surface to move relative to the coated surface of the web, thereby to smooth the coating previously applied by said means.

2. Apparatus as claimed in claim 1 wherein the covering comprises a cellular elastomeric material of which the cells are closed cells, the pitted smoothing surface being formed by part cells.

3. Apparatus as claimed in claim 2 wherein the cellular elastomeric material is foamed neoprene, foamed natural or synthetic rubber, or foamed polyurethane.

4. Apparatus for coating a web of paper or other sheet material, comprising means for applying a liquid coating composition of a surface of the web, and, beyond said means in the direction of web movement, a smoothing roll as claimed in claim 3.

5. Apparatus as claimed in claim 1 wherein the covering comprises a soft solid natural or synthetic rubber having a pitted smoothing surface.

6. Apparatus as claimed in claim 5 wherein the rubber has a hardness of about 30° Shore and a density of up to 0.9 $g/cm^3$.

7. Apparatus as claimed in claim 1 wherein the covering has a laminar construction comprising an impermeable surface layer having a pitted smoothing surface and a resilient under layer of elastomeric material.

* * * * *